US006732617B2

(12) United States Patent
Steinweg et al.

(10) Patent No.: US 6,732,617 B2
(45) Date of Patent: May 11, 2004

(54) REPLACEABLE TOOL TIP

(75) Inventors: Paul S. Steinweg, Litiz, PA (US); Kenneth J. Taggart, Sr., Columbia, PA (US)

(73) Assignee: Hand Tool Design Corporation, Christiana, DE (US)

( * ) Notice: Subject to any disclaimer, the term of this patent is extended or adjusted under 35 U.S.C. 154(b) by 55 days.

(21) Appl. No.: 10/152,608

(22) Filed: May 21, 2002

(65) Prior Publication Data

US 2003/0217622 A1 Nov. 27, 2003

(51) Int. Cl.[7] ..... B25B 7/02

(52) U.S. Cl. ..... 81/423; 403/322.1; 403/324; 279/81

(58) Field of Search ..... 81/421–424; 269/261, 269/283, 284; 279/9.1, 81, 86, 89, 93–94, 97, 104; 403/313, 320, 322.1, 324, 325, 350, 351, 367

(56) References Cited

U.S. PATENT DOCUMENTS

| | | | | | |
|---|---|---|---|---|---|
| 381,544 | A | | 4/1888 | Garvey | |
| 1,408,993 | A | * | 3/1922 | Eberhardt | 279/97 |
| 1,505,510 | A | | 8/1924 | Uhl | |
| 1,556,755 | A | | 10/1925 | Burman | |
| 1,565,210 | A | | 12/1925 | Seiber | |
| 1,809,553 | A | * | 6/1931 | Graul | 279/89 |
| 3,132,550 | A | | 5/1964 | Sion | 81/423 |
| 3,240,519 | A | * | 3/1966 | Weasler | 403/325 |
| 4,105,347 | A | * | 8/1978 | Gossage | 403/324 |
| 4,692,049 | A | * | 9/1987 | Engle | 403/324 |
| 4,775,269 | A | * | 10/1988 | Brix | 279/81 |
| 4,813,829 | A | * | 3/1989 | Koppelmann | 279/81 |
| 6,250,184 | B1 | * | 6/2001 | Chang | 81/421 |
| 6,347,565 | B2 | | 2/2002 | Steinweg | 81/319 |
| 6,568,762 | B2 | * | 5/2003 | Porcheron | 403/321 |
| 6,643,877 | B1 | * | 11/2003 | Amtenbrink et al. | 81/423 |

* cited by examiner

*Primary Examiner*—D. S. Meislin
(74) *Attorney, Agent, or Firm*—Nelson Mullins Riley & Scarborough, LLP

(57) ABSTRACT

A replaceable tip for a tool. A locking pin is disposed on a transverse opening in the end of the tool. A sleeve having a cammed surface formed interiorly is disposed over the end of the tool with the ends of the locking pin contacting the cammed surface. The replaceable tip has a locking keeper which engages the locking pin. Rotation of the sleeve in opposite directions locks or unlocks the locking keeper to the locking pin to allow retention or removal of the tip. In an alternate embodiment the sleeve has opposite spring fingers which contact the ends of the locking pin.

14 Claims, 7 Drawing Sheets

REPLACEABLE TOOL TIP

BACKGROUND OF THE INVENTION

1. Field of the Invention

The present invention relates to a tip for a tool and, more particularly, to a replaceable tip which is easily removed and replaceable by a tip having a different tool member.

2. Description of Related Art

It is highly desirable to have a tool on which the tip can be changed to make the tool more versatile. The substitution of tips on screwdrivers such as to exchange a slot-tip for a Phillips head tip is well known. U.S. Pat. No. 6,347,565 to Steinweg discloses replaceable tips which have pins keyed to slots to lock jaw members onto studs. Other U.S. patents of which the applicant is aware which disclose replaceable tips for tools are:

| U.S. Pat. No. | Inventor(s) |
|---|---|
| 381,544 | Garvey |
| 1,505,510 | Uhl |
| 1,556,755 | Burman |
| 1,565,210 | Seiber |
| 3,132,550 | Sion |

While these patents disclose useful replaceable tips, a more simple, universal type tip is needed.

BRIEF SUMMARY OF THE INVENTION

It is an object of the present invention to provide a replaceable tip for a tool which is easily attached to, and disconnected from, the tool.

It is another object of the present invention to have a replaceable tip which is positively connected to the tool.

In accordance with the teachings of the present invention, there is disclosed a replaceable tip for a tool comprising in combination the tool having a hollow end. A transverse opening is formed in the hollow end of the tool. A locking pin is disposed in the transverse opening, the locking pin having a mid portion and two enlarged opposite ends. The ends of the locking pin extend outwardly from the end of the tool. The end of the tool is received in a sleeve having a cammed inner surface. The opposite ends of the locking pin contact the cammed inner surface of the sleeve. The replaceable tip has a body having a first end and a second opposite end. The first end has a work member formed thereon. The second end has a locking keeper formed thereon. The body of the replaceable tip is received within the sleeve wherein the locking keeper engages the mid portion of the locking pin. Rotating the sleeve in a first direction engages one of the enlarged ends of the locking pin with the locking keeper and locks the replaceable tip on the end of the tool. Rotating the sleeve in a second opposite direction disengages the enlarged ends of the locking pin from the locking keeper. In this manner the replaceable tip may be removed and replaced.

Further in accordance with the teachings of the present invention, there is disclosed a replaceable tip in combination with a tool. The tool has a hollow end. A transverse opening is formed in the hollow end of the tool. A locking pin is disposed in the transverse opening, the locking pin having a mid portion and two enlarged opposite ends. The ends of the locking pin extend outwardly form the transverse opening in the end of the tool. The end of the tool is received in a sleeve. The sleeve has a first finger spring and an opposite second finger spring. The opposite ends of the locking pin contact the opposite finger openings on the sleeve. The replaceable tip has a body having a first end and an opposite second end. The first end has a work member formed thereon. The second end has a locking keeper formed thereon. The second end further has a tapered nose. The body of the replaceable tip is received within the sleeve such that when the replaceable tip is inserted into the sleeve, the tapered nose forces the locking pin against one of the finger springs. Said finger spring flexes such that the mid-portion of the locking pin is received in the locking keeper and retained therein. In this manner, pressure on the one of the finger springs urges the locking pin against the end of the locking pin, releasing the locking pin from the locking keeper, such that the replaceable top may be removed and replaced.

In a further aspect of the present invention, there is disclosed a replaceable tip for a tool comprising, in combination the tool having a hollow end. A transverse opening is formed in the hollow end of the tool. A locking pin is disposed in the transverse opening. The locking has a mid portion and two enlarged opposite ends. The ends of the locking pin extend outwardly from the transverse opening in the end of the tool. The ends of the tool are received in a sleeve. The opposite ends of the locking pin contact the sleeve. The replaceable tip has a body having a first end and an opposite second end. The first end has a work member formed thereon. The second end has a locking keeper formed thereon. The body of the replaceable tip is received within the sleeve wherein the locking keeper engages the mid-portion of the locking pin. The sleeve has means thereon for moving the locking pin laterally within the transverse opening such that movement in a first direction engages one of the enlarged ends of the locking pin with the locking keeper and the replaceable tip is retained. Movement in a second, opposite direction disengages both ends of the locking pin from the locking keeper and the replaceable tip may be removed and replaced.

These and other objects of the present invention will become apparent from a reading of the following specification taken in conjunction with the enclosed drawings.

DESCRIPTION OF THE PREFERRED EMBODIMENTS

Figure 1:
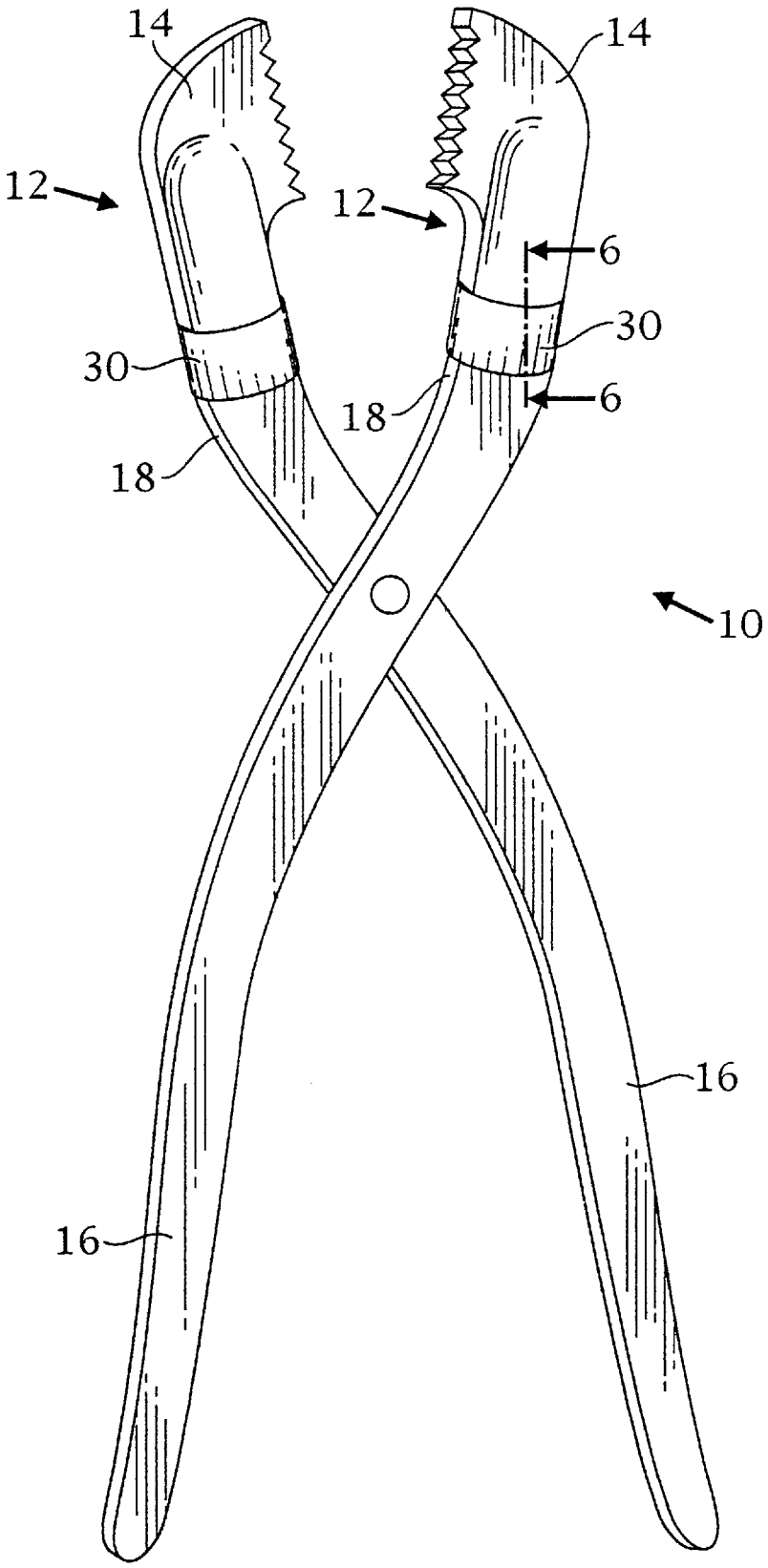
FIG. 1 is a perspective view of a plier-like tool having replaceable tips of the present invention.

Referring now to FIG. 1, a plier-like tool 10 is shown having replaceable tips 12. The tips 12 have jaw-like work members 14 but may have other configuration such as grasping, spreading, clamping, connecting and disconnecting members. As will be explained, the replaceable tips of the present invention may be used on different tools. A plier-like tool is shown herein for convenience of explanation and is in no manner, a limitation of the replaceable tip. In a plier-like tool, a pair of handles 16 pivot about a hub and each handle 16 has an end 18 to which a respective tip 12 is replaceably connected. It is preferred that each end 18 be hollow.

Figure 2:
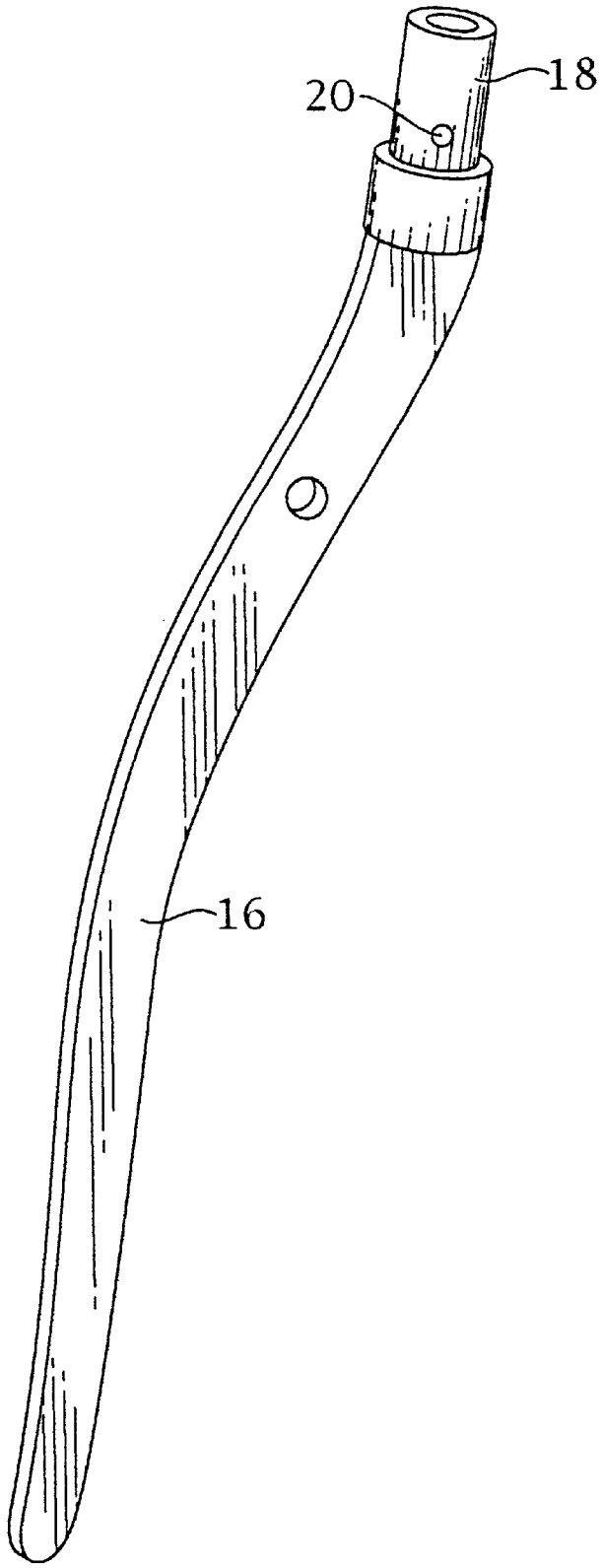
FIG. 2 is a perspective view of a single handle and arm of a plier-type tool showing the end of the tool onto which the tip is replaceably connected.
Figure 3:
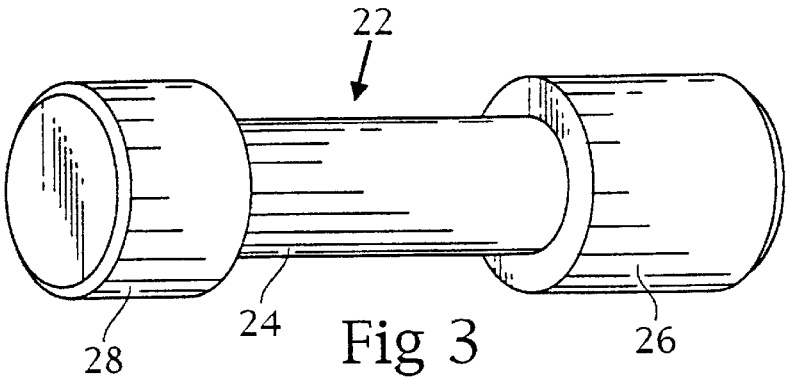
FIG. 3 is an enlarged perspective view of a locking pin.

A transverse opening 20 is formed in the end 18 of each handle 16 of the tool as shown in FIG. 2. A locking pin 22 is disposed in the transverse opening. As shown in FIG. 3, the locking pin 22 has a mid-portion 24, a first end 26 and an opposite second end 28. Both ends 26, 28 have enlarged cross-sectional areas as compared to the cross-sectional area of the mid-portion 24. Also, each end has a respective length. The first end 26 has a length which is greater than the length of the second end 28 for reasons as will be explained. The mid-portion 24 has a uniform cross-sectional area between the first end 26 and the second end 28.

Figure 4:
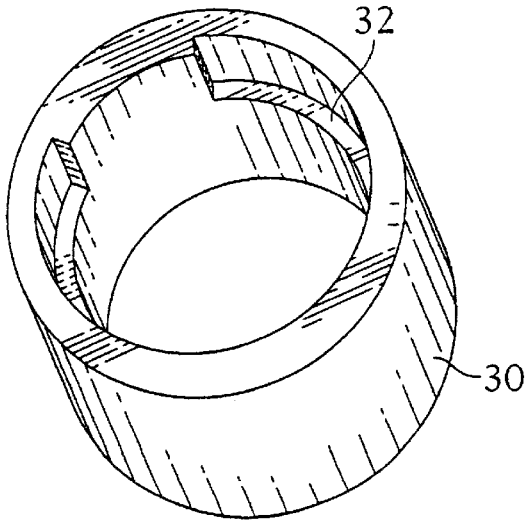
FIG. 4 is an enlarged perspective view of a sleeve.

As shown in FIG. 1, a cylindrical sleeve 30 is disposed over the end 18 of each handle 16. Interiorly of the sleeve 30, there is formed a cammed surface 32 (FIG. 4). Preferably, the cammed surface extends approximately 300° around the inside of the sleeve 30. The sleeve 30 is positioned such that the opposite ends 26, 28 of the locking pin 22 contact the cammed surface 32 within the sleeve 30 as will be described.

Figure 5:
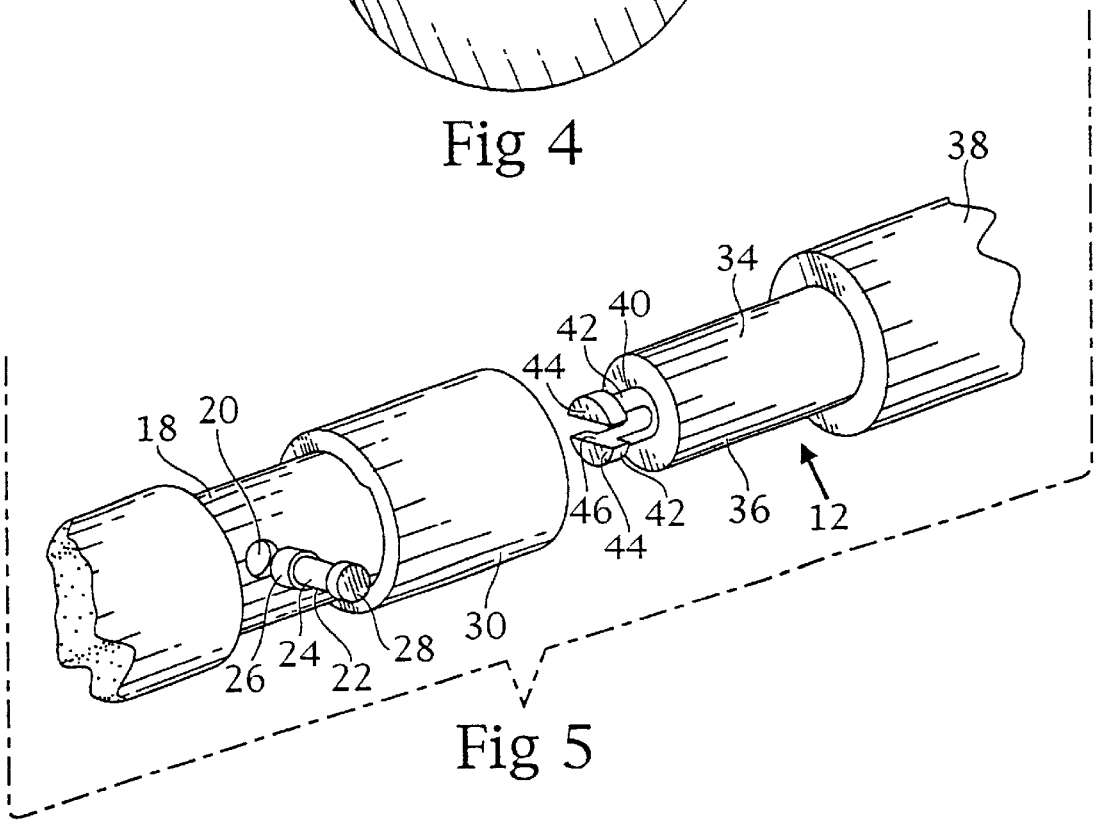
FIG. 5 is an exploded view of the present invention.

As shown in FIG. 5, the replaceable tip 12 has a body 34 which has a first end 36 and a second opposite end 38. The work member 14 is formed on the first end 36 of the body 34. A locking keeper 40 is formed on the second end 38 of the body 34. Preferably, the locking keeper 40 has a pair of bifurcated legs 42. At the end of each bifurcated leg 42, distal from the work member 14, there is formed a protrusion 44 which extends outwardly from the end of each leg 42. A slot 46 is formed between the bifurcated legs 42 and also between the protrusions 44 on the bifurcated legs 2. The body 34 of the replaceable tip 12 is received in the hollow end 18 of the handle such that the mid-portion 24 of the locking pin 22 is received in the slot 46 between the bifurcated legs 42. The bifurcated legs straddle the mid-portion 24 of the locking pins 22.

Figure 6A:
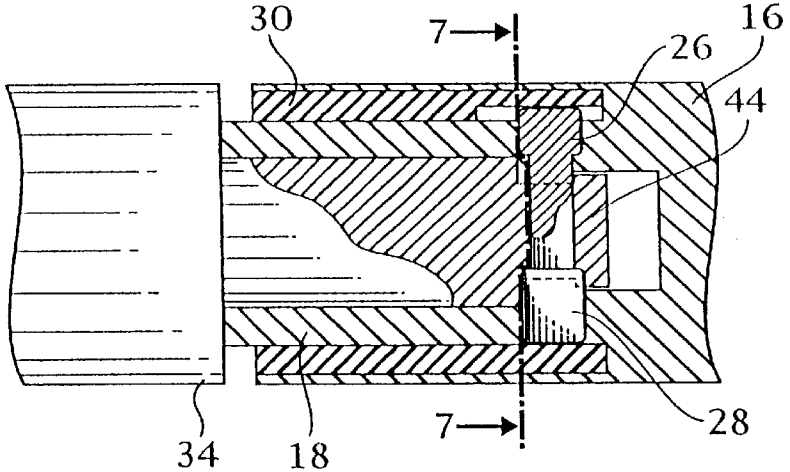
FIG. 6A is a cross-section view of the tip of the present invention taken across the lines 6—6 of FIG. 1 showing the locked position.
Figure 6B:
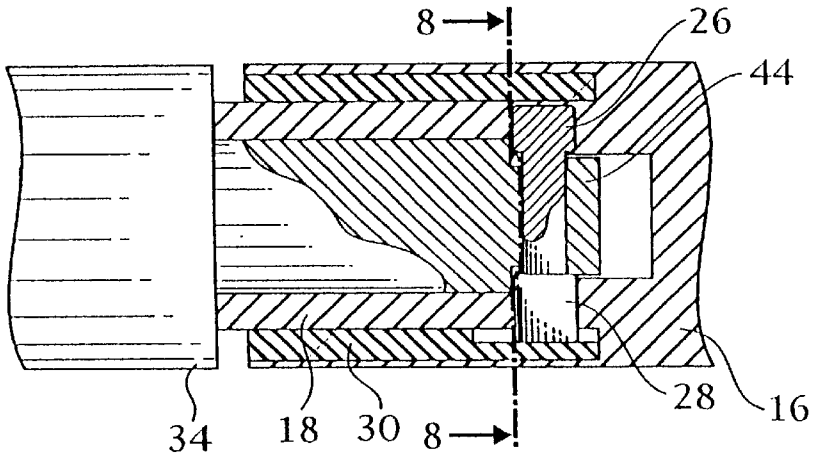
FIG. 6B is a cross-section view of the tip of the present invention taken across the lines 6—6 of FIG. 1 showing the unlocked position.
Figure 7:
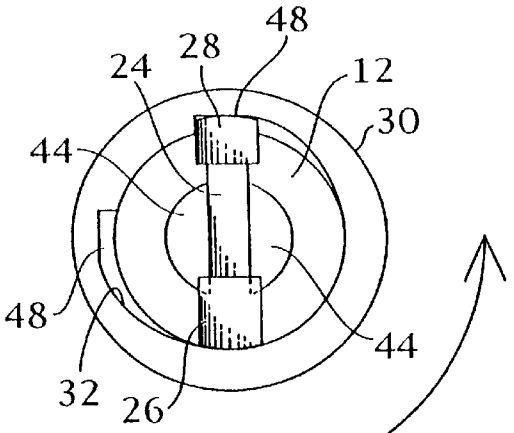
FIG. 7 is a cross-section view taken toward the handle showing the sleeve rotated to a locked position.

As shown in FIGS. 5–7, the locking pin 22 is disposed within the cammed surface 32 in the sleeve 30. Depending upon the direction of rotation of the sleeve 30, either the first end 26 or the second end 28 of the locking pin 22 abuts a flattened terminal 48 of the cammed surface and the opposite end of the locking pin 22 contacts a curved portion of the cammed surface 32.

Figure 9:
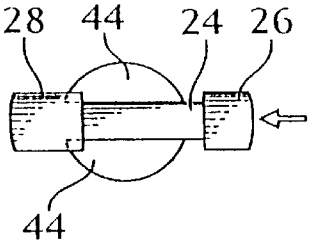
FIG. 9 is a view showing the locking pin in relation to the projections on the locking keeper in the locked position.

When the sleeve 30 is rotated in a first direction (FIGS. 7 and 9) the first end 26 of the locking pin 22 which has the longer length, contacts the curved portion of the cammed surface 12 and the second end 28 of the locking pin 22 contacts the flat terminal 48 of the cammed surface 32. The protrusions 44 on the bifurcated legs 42 extend adjacent to the longer first end 26 of the locking pin 22. The tip 12 cannot be removed from the sleeve 30 because the protrusions 44 are obstructed by the first end 26 of the locking pin 22.

Figure 8:
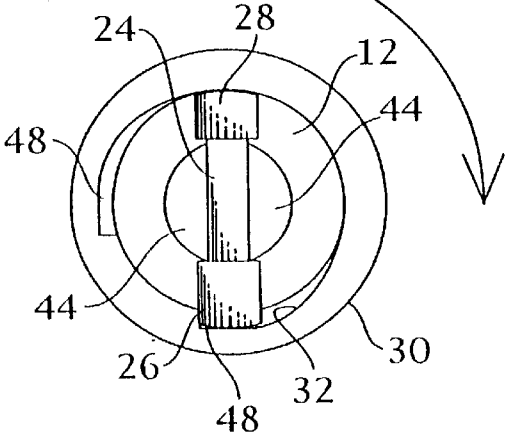
FIG. 8 is a cross-section view taken toward the handle showing the sleeve rotated to an unlocked position.
Figure 10:
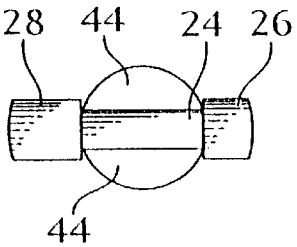
FIG. 10 is a view showing the locking pin in relation to the projections on the locking keeper in the unlocked position.
Figure 11:
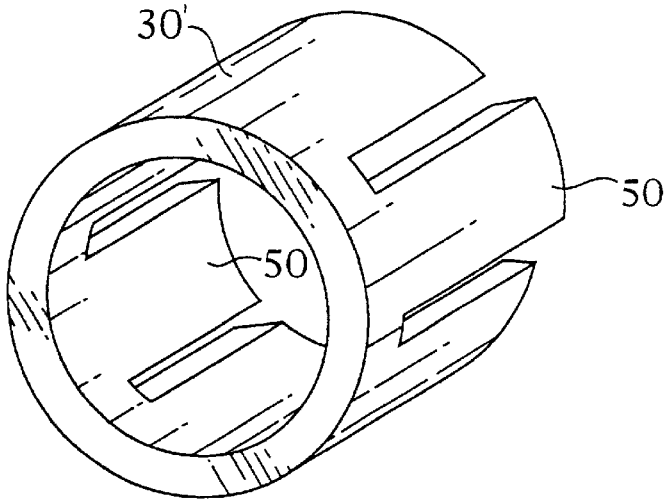
FIG. 11 is a perspective view of a sleeve having opposite finger springs.

When the sleeve 30 is rotated in a second direction (FIGS. 8 and 10) the protrusions 44 are unobstructed and clear of both enlarged ends 26, 28 of the locking pin 22 and the removable tip 12 may be withdrawn from the sleeve 30 for replacement by a different tip.

Preferably, rotation of approximately 90° is sufficient to move the locking pin 22 with respect to the bifurcated legs 42 and the protrusions 44 on the bifurcated legs 42.

Figure 12:
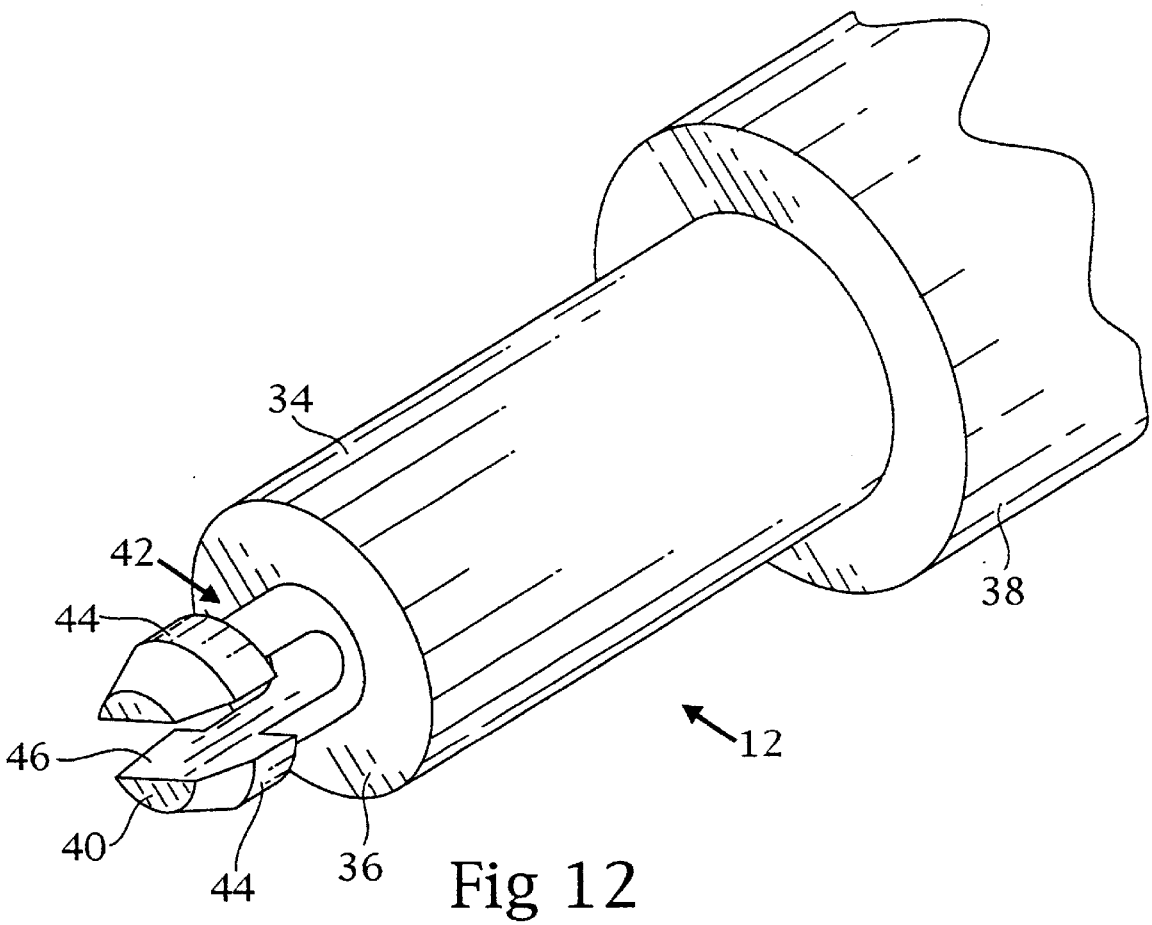
FIG. 12 is a perspective view of the replaceable tip.
Figure 13:
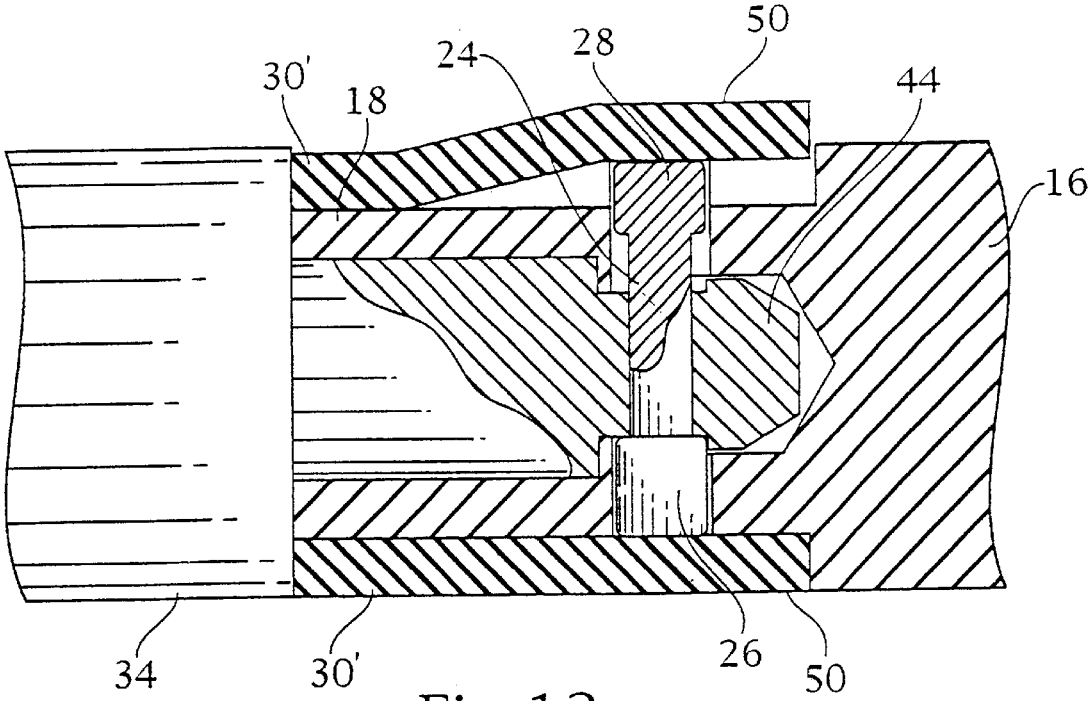
FIG. 13 is a cross-section view of the sleeve with finger springs contacting the locking pin in a locked position.
Figure 14:
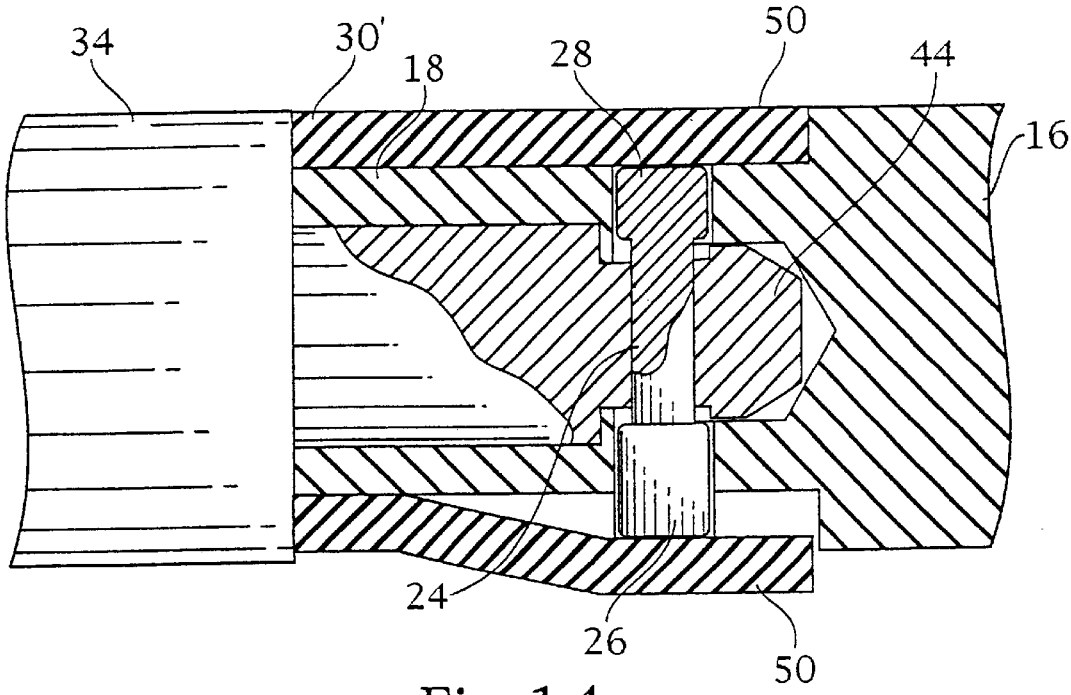
FIG. 14 is a cross-section view of the sleeve with finger springs contacting the locking pin in an unlocked position.

Preferably, the protrusions 44 are semi-circular segments which are mirror images of one another. The advantage of the semi-circular configuration is that the protrusions correspond with the configuration of the hollow end 18 of the handle and bifurcated legs 42 are prevented from being spaced-apart when the sleeve 30 is rotated. However, the protrusions are not limited to the semi-circular configuration. The only limitation is that the protrusions must be able to prevent removal of the FIG. 12 from the locking pin 22 when the sleeve 30 is rotated to the locking position.

In an alternate embodiment, as shown in FIGS. 11–14 the sleeve 30' is securely fitted on each end 18 of each handle 16. This may be a friction fit. The sleeve 30' has at least two opposite finger springs 50 or beams which, preferably, are an integral part of the sleeve 30'. The sleeve 30' may be molded. The replaceable tip 12 has a body 34 with a first end 36 which has a tapered nose which defines the locking keeper 40. The bifurcated legs 42 of the locking keeper 40 each have a protrusion 44 and a slot 46 is formed between the bifurcated legs 42. The replaceable tip 42 is similar to the previously described embodiment except that the protrusions 44 are elongated and tapered. The locking keeper 40 may be viewed as a truncated cone having a slot formed axially therein to form the bifurcated legs 42.

When the tip is to be connected, it is inserted into sleeve 30' such that the locking keeper 40 extends into the hollow end of the tip 12 of the handle. When so inserted, the tapered nose forces the locking pin 22 to move laterally within the transverse opening 20 and to flex one of the finger springs 50 outwardly. This facilitates further insertion of the replaceable tip 12 until the tip 12 has been inserted sufficiently and the mid-portion 24 of the locking pin 22 is received in the slot 46 between the bifurcated legs 42. The longer, first end 26 of the locking pin 22 abuts a portion of the protrusion 44 and effectively prevents removal of the replaceable tip 12.

In order to remove the tip 12 for replacement with a tip having a different work member, pressure is applied to the finger spring 50 which has been flexed outwardly. This pressure is transmitted to the shorter, second end 28 of the locking pin 22 and the locking pin 22 is moved laterally within the transverse opening 20 until the protrusion 44 is no longer abutting the longer, first end 26 of the locking pin 22. The entire length of the protrusion 44 is aligned with the mid-portion 24 of the locking pin 22 and the tip 12 may be removed from the sleeve 30'. As pressure is applied to the one finger spring 50, the one finger spring is no longer flexed outwardly. However, the opposite finger spring 50 is flexed outwardly due to the lateral movement of the locking pin 22 which pressures the longer, first end 26 of the locking pin 22 against the opposite finger spring.

Figure 15:
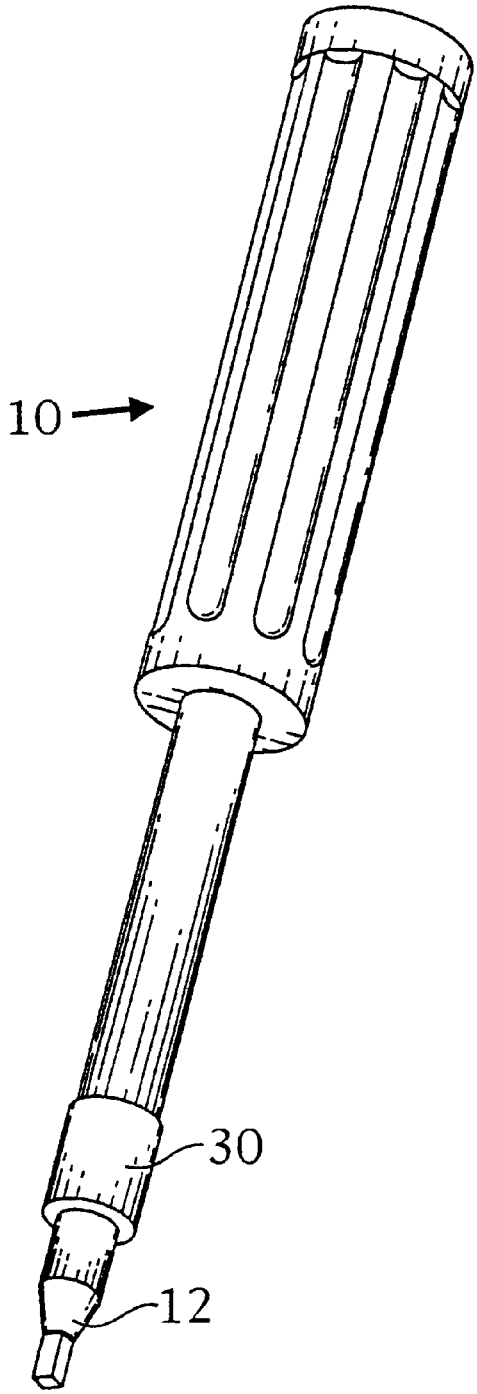
FIG. 15 is a perspective view of the present invention in a screwdriver-like tool.

The tip of the present invention may be used on a wide variety of items including tools, household implements and other items known to persons skilled in the art. As an example, but not as a limitation, FIG. 15 shows the present invention used with a screwdriver-type handle.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A replaceable tip for a tool comprising, in combination, the tool having a hollow end, a transverse opening formed in the hollow end of the tool, a locking pin disposed in the transverse opening, the locking pin having a mid-portion and two enlarged opposite ends, the ends of the locking pin extending outwardly from the transverse opening in the end of the tool, a sleeve in which the end of the tool is received, the sleeve having a cammed inner surface, the opposite ends of the locking pin contacting the cammed inner surface of the sleeve, the replaceable tip having a body having a first end and a second opposite end, the first end having a work member formed thereon, the second end having a locking keeper formed thereon, the body of the replaceable tip being received within the sleeve wherein the locking keeper engages the mid-portion of the locking pin, wherein rotating the sleeve in a first direction engages one of the enlarged ends of the locking pin with the locking keeper and locks the replaceable tip on the end of the tool and rotating the sleeve in a second opposite direction, disengages the enlarged ends of the locking pin from the locking keeper, wherein the replaceable tip may be removed and replaced.

2. The replaceable tip of claim 1 wherein the locking keeper has a pair of bifurcated legs, each leg having an end, a protrusion radiating outwardly from the end of each leg, the protrusions being oriented in opposite directions, a slot being formed between the bifurcated legs, the mid-point of the locking pin being received in the slot between the bifurcated legs, wherein when the sleeve is rotated in the first direction, the protrusions extend adjacent to one of the enlarged ends of the locking pin preventing removal of the replaceable tip and when the sleeve is rotated in the second opposite direction, the protrusions are clear of both enlarged ends of the locking pin, wherein the replaceable tip may be removed from the end of the tool.

3. The replaceable tip of claim 2, wherein the protrusions are semicircular segments which are mirror images of one another wherein one portion of each segment engages the one enlarged head when the sleeve is rotated in the first direction.

4. The replaceable tip of claim 1, wherein the sleeve is rotated through approximately 90°.

5. The replaceable tip of claim 2, wherein the enlarged ends of the locking pin each have a length, the length of one of the enlarged ends being longer than the length of the other enlarged end.

6. The replacement tip of claim 5, wherein the protrusions on the ends of the legs extend adjacent to the longer enlarged head of the locking pin.

7. A replaceable tip for a tool comprising, in combination, the tool having a hollow end, a transverse opening formed in the hollow end of the tool, a locking pin disposed in the transverse opening, the locking pin having a mid-portion and two enlarged opposite ends, the ends of the locking pin extending outwardly from the transverse opening in the end of the tool, a sleeve in which the end of the tool is received, the sleeve having a first finger spring and an opposite second finger spring formed thereon, the opposite ends of the locking pin contacting the opposite finger springs on the sleeve, the replaceable tip having a body having a first end and an opposite second end, the first end having a work member formed thereon, the second end having a locking keeper formed thereon, the second end further having a tapered nose, the body of the replaceable tip being received within the sleeve such that when the replaceable tip is inserted into the sleeve, the tapered nose forces the locking pin against one of the finger springs, said finger spring flexing such that the mid-portion of the locking pin is received in the locking keeper and retained therein, wherein pressure on the one of the finger springs urges the locking pin against the end of the locking pin, releasing the locking pin from the locking keeper, such that the replaceable tip may be removed and replaced.

8. The replaceable tip of claim 7, wherein the locking keeper has a pair of bifurcated legs, each leg having an end, a protrusion radiating outwardly form the end of each leg, the protrusions being oriented in opposite directions, a slot being formed between the bifurcated legs, the mid-point of the locking pin being received in the slot between the bifurcated legs.

9. The replaceable tip of claim 8, wherein the protrusions are semicircular segments which are mirror images of one another wherein one portion of each segment engages the one enlarged head when the replaceable tip is inserted into the sleeve.

10. The replacement tip of claim 8, wherein the enlarged ends of the locking pin each have a length, the length of one of the enlarged ends being longer than the length of the other enlarged end.

11. The replacement tip of claim 10, wherein in a locked position, the protrusions on the ends of the legs extend adjacent to the longer enlarged head of the locking pin.

12. A replaceable tip for a tool comprising, in combination, the tool having a hollow end, a transverse opening formed in the hollow end of the tool, a locking pin disposed in the transverse opening, the locking having a mid-portion and two enlarged opposite ends, the ends of the locking pin extending outwardly from the transverse opening in the end of the tool, a sleeve in which the ends of the tool is received, the opposite ends of the locking pin contacting the sleeve, the replaceable tips having a body having a first end and an opposite second end, the first end having a work member formed thereon, the second end having a locking keeper formed thereon, the body of the replaceable tip being received within the sleeve wherein the locking keeper engages the mid-portion of the locking pin, means on the sleeve for moving the locking pin laterally within the transverse opening such that movement in a first direction engages one of the enlarged ends of the locking pin with the locking keeper and the replaceable tip is retained and movement in an opposite second direction disengages both ends of the locking pin from the locking keeper and the replaceable tip may be removed and replaced.

13. The replaceable tip of claim 10, wherein the means on the sleeve is a cammed surface interiorly of the sleeve.

14. The replaceable tip of claim 12, wherein the means on the sleeve are finger springs on the sleeve.

* * * * *